United States Patent [19]

Honsa

[11] Patent Number: 4,648,468

[45] Date of Patent: Mar. 10, 1987

[54] PORTABLE POWERED TOOL WITH VIBRATION DAMPING

[75] Inventor: Thomas S. Honsa, East Moline, Ill.

[73] Assignee: Honsa Technologies, Moline, Ill.

[21] Appl. No.: 749,154

[22] Filed: Jun. 26, 1985

[51] Int. Cl.[4] ..... B25D 9/04

[52] U.S. Cl. ..... 173/139; 173/162 H; 16/116 R

[58] Field of Search ..... 173/139, 162 R, 162 H; 16/116 R; 74/558.5; 81/489

[56] References Cited

U.S. PATENT DOCUMENTS

| | | | |
|---|---|---|---|
| 2,019,964 | 11/1935 | Hamerly | 173/162 H |
| 2,058,583 | 10/1936 | Forss | 173/162 H |
| 2,425,245 | 8/1947 | Johnson | 173/162 H |
| 3,294,183 | 9/1964 | Riley, Jr. et al. | 173/162 R |
| 3,301,335 | 4/1964 | Snelling | 173/162 R |
| 3,451,492 | 11/1967 | Ekström et al. | 173/162 R |
| 3,735,824 | 5/1973 | Aström | 173/139 X |
| 3,968,843 | 7/1976 | Shotwell | 173/139 |
| 4,073,350 | 2/1978 | Eklöf et al. | 173/139 |

FOREIGN PATENT DOCUMENTS

| | | | |
|---|---|---|---|
| 832729 | 1/1952 | Fed. Rep. of Germany | 173/162 |
| 381743 | 11/1977 | U.S.S.R. | 173/162 H |

*Primary Examiner*—James M. Meister
*Assistant Examiner*—John L. Knoble
*Attorney, Agent, or Firm*—Henderson & Sturm

[57] ABSTRACT

A portable, hand-held tool of the type generating vibration during operation is improved by a construction in which the forward barrel-like part of the tool is embraced by an elastomer-filled cavity or cup in a barrel-related handle, the handle and barrel being typically rigid but separate and secured together by only the elastomer material. The cup-like part of the handle surrounds the rear part of the barrel to afford an annular space, which is filled with initially flowable and subsequently curable elastomer, notably of polyurethane. The base or radial rear wall of the cup is spaced to the rear of the radial rear end of the barrel and this space is contiguous with the annular space and is also filled with the elastomer material. This wall has a through opening to allow for temporary deformation of the elastomer during operation of the tool.

6 Claims, 3 Drawing Figures

PORTABLE POWERED TOOL WITH VIBRATION DAMPING

BACKGROUND

Portable tools of the type forming the subject matter of this application are usually percussion tools; that is, pneumatically powered and comprise such mechanisms as hammers, chippers, drills, grinders and the like; although, there are a rather large variety of tools powered by small internal-combustion engines; e.g., grass and weed trimmers of the string type. Of all tools of this general class, the pneumatic hammers and chisels or chippers are the worst offenders in the area of creating vibrations of such magnitude as to cause relatively serious traumatic conditions in the users, the most common of which is the occupationally-disabling vibration syndrome. Numerous studies of and attempted solutions to the vibration problem have been essayed, directed mainly to the provision of various forms of shock-absorbing materials interposed between the tool handle and the moving part of the tool. Typical of such part-solutions is the disclosure in the Shotwell U.S. Pat. No. 3,968,843, wherein a block of rubber is disposed between the handle and barrel of a pneumatic percussion tool.

SUMMARY OF THE INVENTION

According to the present invention, an improved tool design is provided, employing a rigid handle having a forward cup-like extension which, in assembly, loosely embraces the rear part of the tool barrel, thus affording an annular space. The rear end or rear generally radial face of the barrel part is spaced forwardly of a complementary radial face within the cup-like extension, creating a further space that is contiguous with the annular space. The parts, thus related, are set up in a suitable holding mechanism and the spaces are filled with an elastomer material that is initially pourable but which sets up and cures, being adhered to the interior surface of the cup-like extension and to the extension-surrounded exterior surfaces of the barrel. The elastomer is a polyurethane having a Shore A hardness in the order of 15 to 45, more preferably between 20 and 25.

A further feature is that the base of the cup; i.e., the part that provides the radial wall spaced to the rear of the barrel rear radial wall, has a through opening, closed during assembly and introduction of the elastomer material but left open as a structural and functional attribute lending significantly to the success of the invention, because this opening allows for temporary deformation of the elastomer material during operation of the tool. In the instance of a hammer, chisel, etc., where the forces are directed generally fore-and-aft, the opening is located on a fore-and-aft axis for best results. A significant aspect of the construction is that the cup-like extension has such configuration that its peripheral wall converges forwardly about the rear part of the barrel, enhancing the confinement of the elastomer material and contributing to the ease and comfort of operation as well as to the long life of the tool components.

Further features and advantages of the invention will become apparent as a preferred embodiment thereof is disclosed in the following detailed description and accompanying sheet of drawing.

DETAILED DESCRIPTION OF A PREFERRED EMBODIMENT OF THE INVENTION

Figure 1:
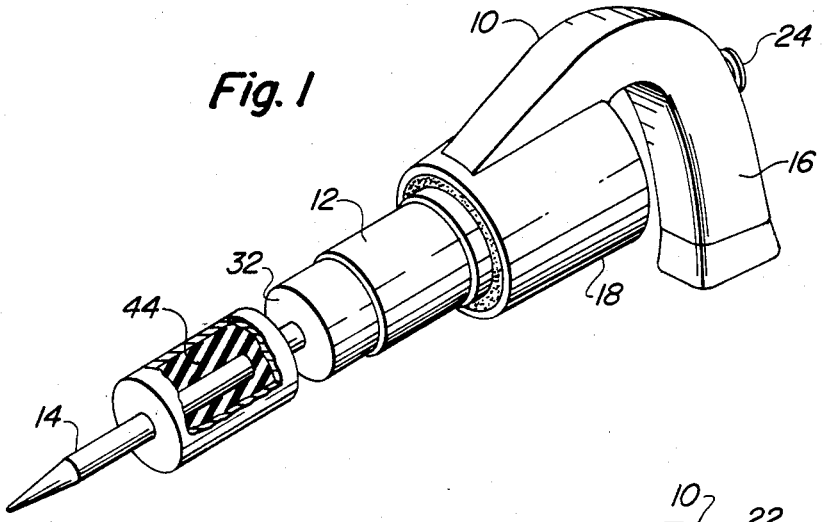
FIG. 1 is a perspective of a representative tool embodying the invention.
Figure 2:
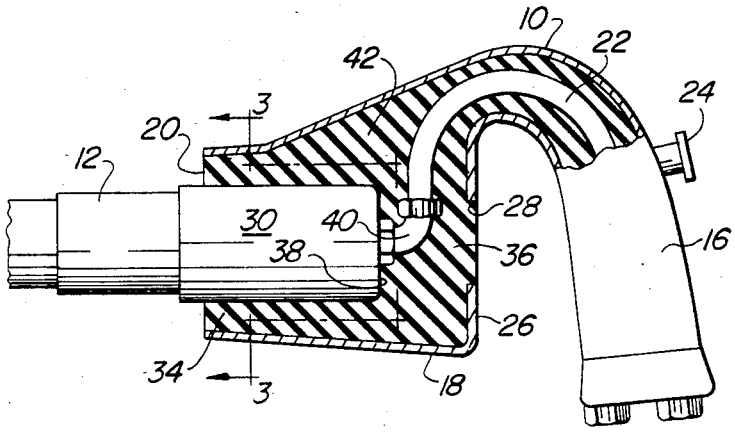
FIG. 2 is a longitudinal section of the rear or handle-barrel part of the tool and showing the basic construction.
Figure 3:
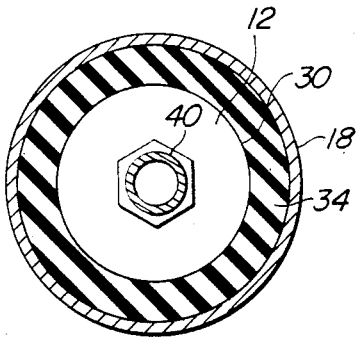
FIG. 3 is a transverse section on the line 3—3 of FIG. 2.

The tool chosen for purposes of disclosure is a pneumatically-powered chipper comprising, essentially, a handle (10), a fore-and-aft barrel (12) and a chipping chisel (14). The handle is a rigid element of suitable rigid material, such as aluminum, for example; although, any equivalent material may be used, all within the expertise of those knowledgeable in the percussion tool field. In the instant case, the handle is of special design, having a grip (16) rigid or integral with a forward cup-like extension or projection (18) which opens at its front end at (20). The handle grip is typically hollow and contains at least part of the air conduit means (22) and exposed trigger (24). The configuration of the cup-like extension is such that it is generally of frustro-conical shape, converging forwardly to the open front end (20) and having a rear radial wall (26) in which is formed a preferably circular opening (28), the purpose of which will appear subsequently herein.

The barrel, as aforesaid, is elongated and rigid fore and aft, being of suitable material such as aluminum, and has a generally cylindrical rear part (30) and an integral front part (32). The interior of the barrel contains typical pneumatically reciprocated mechanism, not shown, for reciprocating the chipper (14), the rear inner end of which is chucked in the barrel in conventional style, also not shown because this is a fundamental familiar to those versed in the art. Suffice it to observe that in operation the tool is subject to a variety of forces, including fore-and-aft, vertical and lateral, and these occur at wide ranges of frequency and amplitude. As noted in the preface hereto, it is these forces toward which intensive studies have been directed, along with several attempted solutions. The basic aim of most solutions is to attempt to insulate the handle from the forces imparted to the barrel, exemplary of which is the Shotwell patent referred to earlier herein, which employs a rubber interface between the handle and barrel.

The present invention takes a significantly different approach, both as to design and material and exploits the relationship between the cup-like extension (18) of the handle and the rear part (30) of the barrel. It will be seen that the diameter of the rear part of the barrel is considerably smaller than the inside diameter of the conical front part of the extension (18) so that when the barrel is initially assembled into the cup-like extension via the front opening (20), an annular space (34) exists. This space changes shape via enlargement as it progresses rearwardly into the extension and handle grip interior and is contiguous with a radial space (36) between the front surface of the rear radial wall (26) of the extension and the rear radial wall (38) of the barrel. Since the handle grip is hollow, the spaces extend into it and all together form a cavity. The handle and barrel are held in temporary vertical alinement in a suitable fixture (not shown), prior to which the air line (22) is connected to the rear of the barrel by a suitable fitting (40). With the parts held in a fixture as aforesaid, elastomer material (42) is poured or flowed into the assembled barrel and extension filling the cavity already noted and encasing the air conduit as well. The opening (28) will have been temporarily closed to prevent the escape of elastomer material. After the material has set and cured, the opening is uncovered. The material effects a tight bond or adherence to the walls defining the cavity made up by the spaces described. If desired, the interior faces of the walls may be roughened, as by sand blasting (a known practice) and coated with a suitable bonding agent. The elastomer material is preferably polyurethane of a composition yielding a Shore A hardness in the range of 15 to 45, more desirably between 20 and 25. Polyurethane is preferred to rubber because the latter is subject to earlier deterioration since it is easily attacked by oils and often becomes brittle and breaks down after rather short periods of operation.

During operation of the present tool, the opening (28) in the rear wall (26) of the forward extension (18) enables rearward bulging of the elastomer material. Preliminary tests have shown a marked reduction in total forces transmitted to the operator. To further add to the comfort of the user, the chisel may be equipped with a cylinder (44) of elastomer material of the type described. This cylinder adheres to an intermediate part of the chisel and enables the user to comfortably use both hands on the tool. The cylinder is preferably disposed on the fore-and-aft axis of both the chipper and the tool itself. Also, the opening (28) in the rear wall part of the extension is primarily on this axis to accommodate basic fore-and-aft forces.

The cooperative shapes of the handle extension (cup) and embraced part of the barrel provide an improved interlock of the two by the captive elastomer. The handle may or may not be exteriorly covered with padding of suitable type, which is a matter of choice. Many variations in and additions may be made to the specific embodiment disclosed, all without departure from the spirit and scope of the invention.

I claim:

1. A portable, powered hand-held tool of the type generating vibration in operation and having a rigid handle and a separate, rigid fore-and-aft barrel including a rear part adjacent to the handle and a front part rigidly related to the rear part and adapted to receive a work-performing element, characterized in that the rear part is of generally cylindrical section on the fore-and-aft axis of the barrel and has a peripheral outer surface and also a rear end generally radial surface facing toward the handle, the handle includes rigid therewith a forwardly projecting cup-like extension substantially coaxial with the rear barrel part and opening forwardly to receive and loosely surround said rear part, said extension including an interior peripheral wall surface of greater diameter than the rear barrel part and combining with the exterior surface of said part to form an annular space, said extension further including rigid therewith a rear, generally radial wall providing an interior front surface spaced rearwardly of the rear surface of the barrel to provide a further space contiguous with the annular space, and a filling of shock-absorbing elastomer material is contained within and fills said spaces and is adhered to the interior surfaces of the extension and to the extension-surrounded surfaces of the barrel.

2. The tool of claim 1, further characterized in that the peripheral wall surface of the extension converges forwardly about the rear part of the barrel.

3. The tool of claim 1, further characterized in that the radial wall of the extension has an opening therethrough to enable rearward expansion of the elastomer material.

4. The tool of claim 2, further characterized in that the opening is substantially centered on the aforesaid fore-and-aft axis.

5. The tool of claim 1, further characterized in that at least a portion of the handle is hollow and in communication with the aforesaid spaces and the elastomer material extends into and fills the hollow portion of the handle.

6. The tool of claim 5, further characterized in that a flexible fluid conduit extends through the hollow portion of the handle and through the space between the barrel rear part end surface and the extension radial wall and is connected to the barrel rear part, and the elastomer material surrounds and tightly encases the conduit.

* * * * *